United States Patent [19]

Premel

[11] Patent Number: 4,841,917

[45] Date of Patent: Jun. 27, 1989

[54] RADIATION COOLING UNIT FOR COOLING DUST-LADEN GASES

[75] Inventor: Ulrich Premel, Gummersbach, Fed. Rep. of Germany

[73] Assignee: L. & C. Steinmüller GmbH, Gummersbach, Fed. Rep. of Germany

[21] Appl. No.: 226,125

[22] Filed: Jul. 29, 1988

[30] Foreign Application Priority Data

Jul. 31, 1987 [DE] Fed. Rep. of Germany ..... 3725424

[51] Int. Cl.[4] ..... F22B 37/18; F22B 37/48

[52] U.S. Cl. ..... 122/379; 165/84; 165/95

[58] Field of Search ..... 122/379; 165/84, 95

[56] References Cited

U.S. PATENT DOCUMENTS

| | | | |
|---|---|---|---|
| 3,835,817 | 9/1974 | Tuomaala | 122/379 |
| 3,997,000 | 12/1976 | Piela | 165/84 |
| 4,018,267 | 4/1977 | Tomasicchio | 165/84 |
| 4,497,282 | 2/1985 | Neundorfer | 122/379 |

*Primary Examiner*—Edward G. Favors

*Attorney, Agent, or Firm*—Becker & Becker, Inc.

[57] ABSTRACT

A radiation cooling unit for cooling dust-laden gas. At least one cylindrical radiation heat transfer surface is disposed in a tank adjacent to, and extending essentially along the length of, an inner wall of the tank. First knock-or impact-beating devices disposed externally of the tank act upon the cylindrical heat transfer surface through the wall of the tank. A plurality of essentially radially and axially extending, partition-like radiation heat transfer surfaces are disposed within a free space in the tank, and each comprise axially extending tubes and at least one header. Second knock- or impact-beating devices are disposed externally of the tank, extend through the cylindrical heat transfer surface, and act upon radially outwardly disposed edges of the partition-like heat transfer surfaces, with the length-to-width ratio of the latter being such that they are adapted to be accelerated and cleaned by the second knock- or impact-beating devices. The partition-like radiation heat transfer surfaces are preferably radially distributed about the periphery of the cooling unit.

7 Claims, 2 Drawing Sheets

RADIATION COOLING UNIT FOR COOLING DUST-LADEN GASES

BACKGROUND OF THE INVENTION

The present invention relates to a radiation cooling unit for cooling dust-laden gases. The unit includes a tank, at least one cylindrical radiation heat transfer surface that is disposed adjacent to, and extends essentially along the length of, the inner wall of the tank, and knock-or impact-beating devices that are disposed externally of the tank and act upon the cylindrical radiation heat transfer surface through the wall of the tank.

The prospectus "Anlagen- und Apparatebau-Komponenten und Teilkreislaufe" P 8604-06-05/1.L (1986) page 27, discloses, for a coal gasification unit in a molten iron bath, a radiation cooler that is disposed downstream of the bath, is provided with a radiation heat transfer surface, and can be cleaned with mechanically or pneumatically operated knocking- or impact-beating devices. the cylindrical radiation heat transfer surface is of tube-web-tube construction, whereby the tubes can extend parallel to the axis of the tank.

The knock- or impact-beating device can be of the type disclosed in U.S. Pat. No. 4,457,361, which belongs to the assignee of the present invention, and where the impact piston, which comes into engagement with the cooling surface, extends through the wall of the pressure tank, with the free end of the impact piston being acted upon by the transfer piston of the pulse generator.

The knock- or impact-beating devices are required because the heretofore known radiation cooler tends to become dirty or clogged due to the presence of the solid constituents in the gas that is to be cooled off. In addition, merely the arrangement of the wall heat transfer surfaces causes the space of the radiation cooler to be poorly utilized.

It is therefore an object of the present invention to provide a radiation cooling unit of the aforementioned general type where the space in the cooling unit can be better utilized, or the cooling unit can have smaller dimensions.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
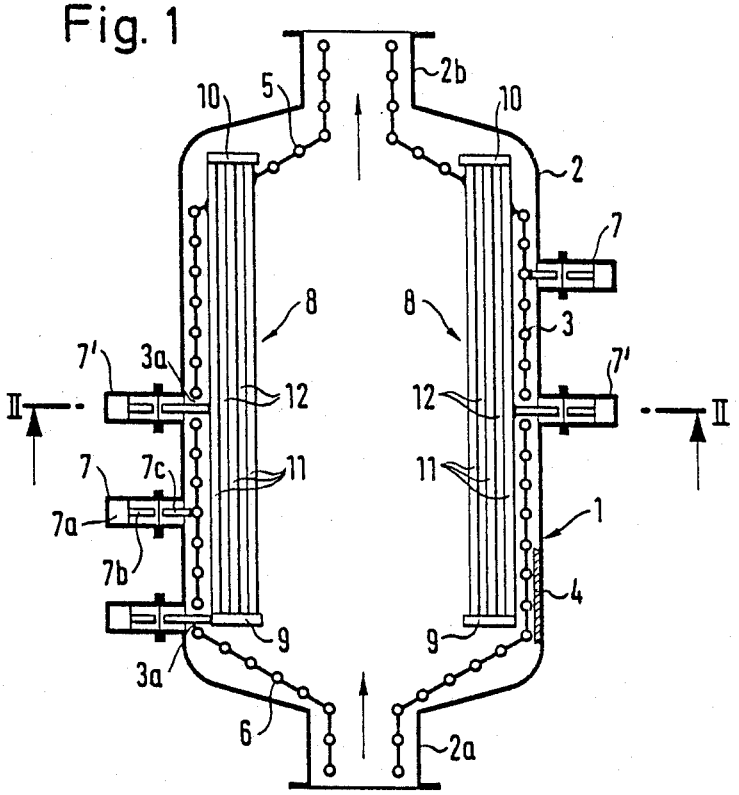
FIG. 1 is a vertical cross-sectional view through one exemplary embodiment of the inventive radiation cooling unit.

The radiation cooling unit of the present invention comprises: a tank having an inner wall; at least one cylindrical radiation heat transfer surface that is disposed in the tank adjacent to, and extending essentially along the length of, the inner wall of the tank, with a free space being provided in the tank and being delimited by the cylindrical radiation heat transfer surface; first knock- or impact-beating devices that are disposed externally of the tank and act upon the cylindrical radiation heat transfer surface through the wall of the tank; a plurality of essentially radially and axially extending, platen- or partition-like radiation heat transfer surfaces that are disposed within the free space in the tank, with each partition-like radiation heat transfer surface comprising axially extending tubes and at least one accumulator or header; and second knock- or impact-beating devices that are also disposed externally of the tank, extend through the cylindrical radiation heat transfer surface, and act upon radially outwardly disposed edges of the partition-like radiation heat transfer surfaces, with the length-to-width ratio of the partition-like radiation heat transfer surfaces being such that they are adapted to be accelerated and cleaned by the second knock- or impact-beating devices.

By providing partition-like radiation heat transfer surfaces with which are associated knock- or impact-beating devices, the space in the radiation cooling unit is better utilized, and the cooling unit, and hence the pressure tank, can have correspondingly smaller dimensions.

The partition-like radiation heat transfer surfaces are preferably distributed radially about the periphery of the cooling unit.

If the partition-like radiation heat transfer surfaces have a tube-fin-tube construction, impact or knocking can take place at any desired location of the radially outermost tube or on the associated header. It is possible for the partition-like radiation heat transfer surface to have a respective header at the top and at the bottom, or to provide only a single header at either the top or the bottom, and to embody the tubes as loops.

If a tube-fin-tube construction is not used, the partition-like radiation heat transfer surfaces are embodied as spaced-apart smooth tubes, and an impact transferring mechanism for the transfer of impact energy from tube to tube is provided in the effective range of the knock- or impact-beating device. The impact transferring mechanism can, for example, be the header itself for the heat transfer surface. However, it is also possible to form the impact transferring mechanism from transfer elements disposed between the tubes when, for example, the knock- or impact-beating device is not to act upon one end of the longitudinal edge, but rather upon, for example, the central portion of the edge.

Finally, it is also possible to associate several knock- or impact-beating devices with the radially outermost longitudinal edge of one of each partition-like radiation heat transfer surface.

Further specific features of the present invention will be described in detail subsequently.

DESCRIPTION OF PREFERRED EMBODIMENTS

Figure 2:
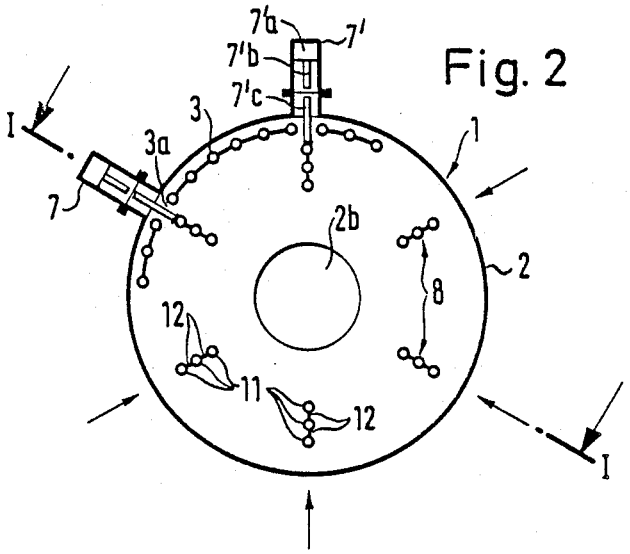
FIG. 2 is a cross-sectional view taken along the line II—II in FIG. 1.

Referring now to the drawings in detail, the radiation cooling unit 1 illustrated in FIGS. 1 and 2 includes a pressure tank 2 that has a gas inlet **2*a* and a gas outlet 2*b***.

Disposed in the tank 2 is a multiply coiled radiation heat transfer surface 3 of tube-web-tube construction. Disposed between the outer surface of the radiation heat transfer surface 3 and the inner wall of the tank 2 is an insulating packing mass 4. For the sake of simplification, the packing mass 4 is indicated only in the lower right hand portion of FIG. 1. Associated with the cylindrical heat transfer surface 3 are a cover section 5 and a bottom section 6. (Note that the heat transfer surface 3 can also be constructed with linear tubes pursuant to the state of the art.)

The cylindrical radiation heat transfer surface 3 can be knocked or struck by knock- or impact-beating devices 7 that are disposed externally of the tank 2, and are described in U.S. Pat. No. 4,457,361, which belongs to the assignee of the present application. Schematically illustrated in FIG. 1 are the pulse generator *7a*, the transfer piston *7b*, and the actual impact piston *7c*, which acts upon the heat transfer surface 3.

A plurality of platen- or partition-like radiation heat transfer surfaces 8 are distributed about the periphery of the radiation cooling unit 1 in the tank 2 in a radial manner and within the free space delimited by the cylindrical radiation heat transfer surface 3. In the embodiment illustrated in FIG. 1, the partition-like radiation heat transfer surfaces 8 comprise accumulators or headers 9 and 10 between which extend tubes 11 and webs or fins 12. The partitions 8 extend radially and along the length of the tank 2, and are preferably welded into the cover section 5 in the manner indicated in FIG. 1.

Associated with the partition-like radiation heat transfer surfaces 8 are knock- or impact-beating devices 7' of the same type of construction as the devices 7. The impact pistons *7'c* (FIG. 2) of the devices 7' extend through openings *3a* in the radiation heat transfer surface 3. To show some different possibilities for the knocking process, the left hand partition-like radiation heat transfer surface 8 in FIG. 1 is knocked approximately centrally against its outwardly disposed tube 11 and against its lower header 9. Under certain circumstances, it would also be sufficient to only centrally knock the individual partition-like heat transfer surfaces, as indicated on the right hand side of FIG. 1.

Figure 3:
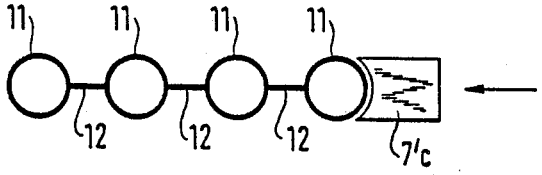
FIG. 3 is a horizontal cross-sectional view through one exemplary embodiment of an inventive partition-like radiation heat transfer surface in tube-fin-tube construction.
Figure 4:
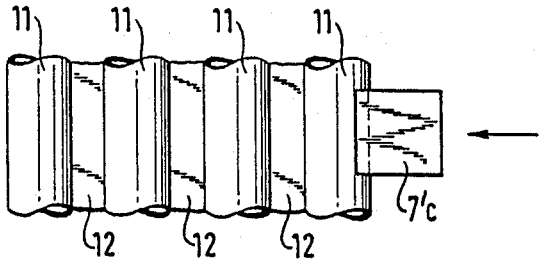
FIG. 4 is a partial plan view of the partition-like radiation heat transfer surface of FIG. 3.

The enlarged partial views of FIGS. 3 and 4 show the knocking of partition-like radiation heat transfer surfaces of tube 11-fin 12-tube 11 construction.

Figure 5:
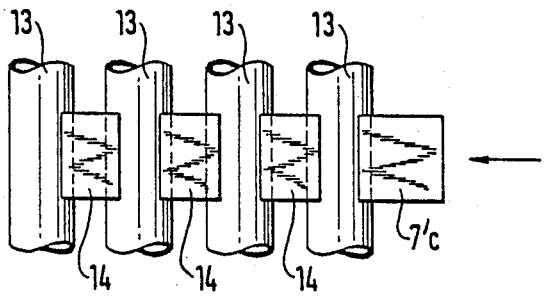
FIG. 5 is a partial plan view of another exemplary embodiment of an inventive partition-like radiation heat transfer surface that is provided with transfer elements.
Figure 6:
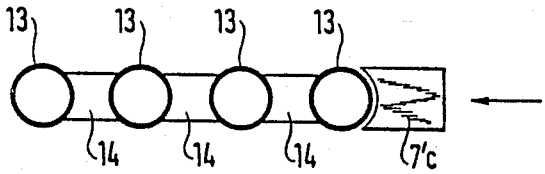
FIG. 6 is a horizontal cross-sectional view through the partition-like radiation heat transfer surface of FIG. 5.

FIGS. 5 and 6 illustrate the knocking of a partition-like radiation heat transfer surface that is constructed of smooth tubes 13 that extend between the headers. Disposed between the tubes 13, in the effective range of the knock- or impact-beating device 7', i.e., the element *7'c* thereof, are transfer elements 14 that are welded to the tubes 13.

It is to be understood that the present invention is not limited to the use of knock- or impact-beating devices 7 and 7' of the type disclosed in the aforementioned U.S. Pat. No. 4,457,361; other types or knock- or impact-beating devices could also be used. However, the knock- or impact-beating device of U.S. Pat. No. 4,457,361 offers particularly the advantage that with it the knock or impact energy can be transferred in a simple manner onto the heating or cooling surfaces that are installed in containers or tanks that are operated on the gas side at an elevated pressure relative to the ambient atmospheric pressure. Although in the illustrated embodiment the gas flows through the tank from the bottom toward the top, it would also be possible to reverse this direction of flow.

The present invention is, of course, in no way restricted to the specific disclosure of the specification and drawings, but also encompasses any modifications within the scope of the appended claims.

What I claim is:

1. A radiation cooling unit for cooling dust-laden gas, said cooling unit comprising:

a tank having an inner wall;

at least one cylindrical radiation heat transfer surface that is disposed in said tank adjacent to, and extending essentially along the length of, said inner wall of said tank, with a free space being provided in said tank and being delimited by said cylindrical radiation heat transfer surface;

first knock- or impact-beating devices that are disposed externally of said tank and act upon said cylindrical radiation heat transfer surface through the wall of said tank;

a plurality of essentially radially and axially extending, partition-like radiation heat transfer surfaces that are disposed within said free space in said tank, with each partition-like radiation heat transfer surface comprising axially extending tubes and at least one header; and second knock- or impact-beating devices that are also disposed externally of said tank, extend through said cylindrical radiation heat transfer surface, and act upon radially outwardly disposed edges of said partition-like radiation heat transfer surfaces, with the length-to-width ratio of said partition-like radiation heat transfer surfaces being such that said last-mentioned surfaces are adapted to be accelerated and cleaned by said second knock- or impact-beating devices.

2. A radiation cooling unit according to claim 1, in which said partition-like heat transfer surfaces are uniformly radially distributed about the periphery of said cooling unit.

3. A radiation cooling unit according to claim 1, in which each of said partition-like heat transfer surfaces has a tube-fin-tube construction.

4. A radiation cooling unit according to claim 1, in which each of said partition-like heat transfer surfaces is comprised of spaced-apart smooth tubes and an impact transferring mechanism that is disposed in the effective range of said second knock- or impact-beating device for transferring impact energy from tube to tube.

5. A radiation cooling unit according to claim 4, in which said impact transferring mechanism is said header.

6. A radiation cooling unit according to claim 4, in which said impact transferring mechanism is formed by transfer elements that are disposed between said tubes.

7. A radiation cooling unit according to claim 1, in which a plurality of said second knock-or impact-beating devices are associated with a radially outwardly disposed longitudinal edge of each of said partition-like radiation heat transfer surfaces.

* * * * *